United States Patent [19]

Weinrib

[11] Patent Number: 4,815,929

[45] **Date of Patent: * Mar. 28, 1989**

[54] EDDY PUMP

[75] Inventor: Harry P. Weinrib, Chicago, Ill.

[73] Assignee: Eddy Pump Corporation, Lincolnwood, Ill.

[ * ] Notice: The portion of the term of this patent subsequent to Jun. 24, 2003 has been disclaimed.

[21] Appl. No.: 877,267

[22] Filed: Jun. 23, 1986

Related U.S. Application Data

[63] Continuation of Ser. No. 617,354, Jun. 5, 1984, Pat. No. 4,596,511.

[51] Int. Cl.[4] ..... F04D 5/00

[52] U.S. Cl. ..... 415/53 R; 415/120; 415/213 A

[58] Field of Search ..... 415/83, 88, 53 R, 213 A, 415/120, 1, 89, 52, 213 R, 213 C

[56] References Cited

U.S. PATENT DOCUMENTS

| | | | |
|---|---|---|---|
| 1,945,759 | 11/1933 | Sim | 417/67 |
| 2,148,131 | 9/1936 | Parker | 417/54 |
| 2,480,969 | 10/1946 | Rosa | 417/76 |
| 2,690,130 | 11/1949 | Boeckeler | 417/83 |
| 3,072,057 | 2/1960 | Rosa | 417/90 |
| 3,093,080 | 3/1963 | Tarifa et al. | 415/24 |
| 3,151,560 | 2/1964 | Rosa | 417/69 |
| 3,304,066 | 7/1964 | Vieceli et al. | 261/29 |
| 3,477,383 | 3/1968 | Rawson et al. | 415/88 |
| 3,519,365 | 9/1968 | Conhagen | 415/88 |
| 3,776,658 | 12/1973 | Erickson | 415/88 |
| 3,791,757 | 2/1974 | Tarifa et al. | 415/89 |
| 3,809,491 | 5/1974 | Banyai | 415/88 |
| 3,817,659 | 6/1974 | Erickson et al. | 417/84 |
| 4,161,448 | 7/1979 | Erickson et al. | 210/258 |
| 4,278,397 | 7/1981 | Bachl | 415/83 |

FOREIGN PATENT DOCUMENTS

| | | | |
|---|---|---|---|
| 971042 | 11/1958 | Fed. Rep. of Germany | 415/53 R |
| 42116 | 4/1959 | Poland | 415/53 R |
| 937785 | 10/1980 | U.S.S.R. | 415/53 R |
| 840486 | 6/1981 | U.S.S.R. | 415/53 R |

*Primary Examiner*—Robert E. Garrett
*Assistant Examiner*—Joseph M. Pitko
*Attorney, Agent, or Firm*—Fitch, Even, Tabin & Flannery

[57] ABSTRACT

A method and apparatus for pumping liquid includes a pump casing with a vortex generating member which generates a swirling column of liquid which swirls about a central axis and which is directed through the pump inlet to discharge into the ambient body of liquid at which its energy is quickly dissipated. The surrounding ambient liquid is drawn through the pump inlet in a counterflow to the vortex column flow and flows into the pump casing and then out through a pump discharge. The preferred vortex generating member has channels of decreasing size converging toward the axis of the vortex column with the streams of liquid increasing their respective velocities as they flow toward the axis at which the streams join and concentrate their energies to form the vortex column. Preferably, the vortex member is drive by a power source.

2 Claims, 3 Drawing Sheets

EDDY PUMP

This is a continuation of application Ser. No. 617,354, filed June 5, 1984, now U.S. Pat. No. 4,596,511.

BACKGROUND OF THE INVENTION

This invention relates to a pump and more particularly to pumping apparatus in which there is a counterflow of liquid through the pump.

The present invention is directed to a pump mechanism which is particularly useful in replacing current centrifical pumps which use a motor driven impeller within a close fitting housing. Also, the present invention is of particular utility in operations currently using centrifugal pumps to pump liquids containing large quantities of foreign matters, such as slurries. A particular problem with such pumps is the clogging thereof by the matter being carried by the liquid which is often in the form of silt, sewage, chemicals, foods, particulates, etc. Typical uses of such pumps are in mining operations dredging silt from harbors, canal digging, laying of pipes, laying of cable through water, industrial purposes, sewage systems, etc.

When pumping liquids having abrasive foreign substances therein in relatively high quantities, the centrifical pumps may have an extremely short life because of wear and tear from the foreign substances, or the over filling of spaces within the pump by the foreign substances eventually clogging the pump. To counteract such wear and tear, centrifical pumps may be provided with heavy liners which are expensive initially and particularly when they have to be replaced or repaired. With the present invention, large open spaces in the pump casing and the absence of direct impact against an impellor blade alleviate such wear or clogging problems.

Another problem with current centrifical pumps is the development of sufficient total head which includes a suction lift which the vertical distance from the level of the pump inlet to the pump, and additionally, the discharge lift which is the vertical distance between the pump and pump discharge outlet. The commonly used centrifically pumps for slurries, or the like, are driven at low rpm, particularly where the suction lift is relatively high. In such pumps, an increase in the pump speed actually results in a reduction of the suction lift produced by the pump so that the suction lift can not be improved by increased pump speed. With the present invention, however, increase of suction lift may be obtained by increased speed of the rotating member of the pump.

For a number of centrifugal pumps the suction lift usually very limited and most often limited to atmospheric pressure without the use of special valves or other equipment. When the desired suction lift is greater than this, a vertical pump is often resorted to. The vertical pump uses a long shaft extending from a motor located above the body of liquid and with the long shaft extending downwardly to the submerged pump housing in which is mounted the rotating impeller. The long shaft and the bearings for supporting the shaft constitute limitations on the pump. The pump shaft is necessarily heavy and wastes energy to rotate the heavy shaft. The length of the shaft can not be excessive without being very expensive and necessitating expensive bearings and other supporting equipment. Another form of submersible pump has the motor submersed with the pump housing into the liquid and this requires oil or other material in the pump motor and the use of seals and other expensive devices to prevent the intrusion of liquid into the motor. Additional problems with submersible pumps having submerged motors is that of preventing electrical shock or short circuit. Repairs or replacement of the pump is expensive because it is located at considerable depth. With the present invention large suction lifts may be obtained without shafts or submerging the pump motor.

Accordingly, a general object of the present invention is to provide a new and improved pump.

Another object of the invention is to provide a new and improved pump for handling slurries containing a high percentage of foreign substances without clogging or damaging the pump.

A further object of the invention is to provide an eddy current pump in which a vortex column of liquid is discharged from the center of the pump inlet pipe resulting in a concentrated area of reduced pressure at the pump inlet to cause the ambient surrounding liquid and foreign substances, if any, to be drawn upwardly about the downwardly traveling vortex column in the manner of an eddy current.

These and other objects and advantages of the current invention which become apparent from the following described are taken in connection with the accompanying drawings in which:

Figure 1:
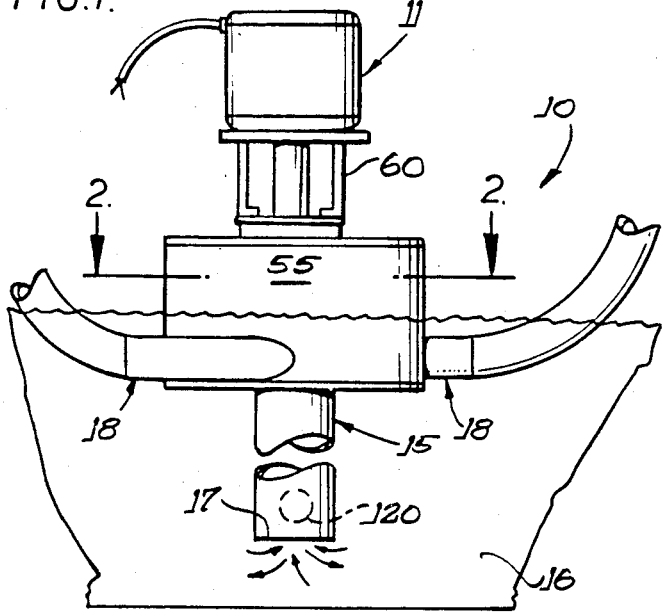
FIG. 1 is a perspective view of the pump embodying the novel features of the invention.

As shown in the drawings for purposes of illustration, the invention is embodied in a pump 10 having an electric motor 11 (FIG. 1) which drives a shaft 12 extending to a pump housing or casing 14. The illustrated pump has a pump inlet means in the form of an inlet conduit 15 which extends into a body of liquid 16 for lifting the liquid into the casing 14 from which the liquid is discharged through one or more pump discharges or outlets 18. The present invention will be described hereinafter in connection with a vertical orientation of the pump 10 (FIG. 1) or a vertical orientation of the alternative embodiment pump **10*a* shown in FIG. 7**. It is to be understood that the pump is capable of being orientated in various manners and that the vertical directions given herein are by way of illustration only and are not intended to limit the invention to any particular orientation of the pump.

As explained previously, the vertical lift from a pump inlet end 17 to the pump casing 14 is termed "suction lift." The amount of suction lift usually is very limited for most pumps of the centrifugal types without the use of special valves. When the desired suction lift is greater than atmospheric pressure a vertical pump is often used. One form of the vertical pump uses a long shaft extending from the motor being located above the body of liquid and with the long shaft 12 extending downwardly to the submerged pump housing in which is mounted the rotating impeller. The long shaft and the bearings for supporting the shaft constitute limitations on the pump. The pump shaft is necessarily heavy and wastes energy to rotate the heavy shaft. The length of the shaft can not be excessive without being very expensive and necessitating expensive bearings and other supporting equipment. Another form of submersible pump has the motor submerged with the pump housing into the liquid and this requires oil or other material in the pump motor and the use of seals and other expensive devices to prevent the intrusion of liquid into the motor. Additional problems with submersible pumps having submerged motors is that of preventing electrical shock or short circuit. Repairs or replacement of the pump is expensive because of its internal construction.

In accordance with the present invention, there is provided a new and improved pump which is particularly useful for pumping liquids containing slurries or other foreign matters in relatively high percent of solids without having to submerge the motor 11, and yet, which can enjoy large suction lifts. This is achieved in the present invention by the generation of a vortex column 30 (FIG. 6) of rapidly swirling liquid, swirling about a central axis 32 through a vortex generating means or member 35 (FIG. 6) or 35*a* (FIG. 7). The vortex generating member generates the vortex column 30 of liquid in which the liquid has a high velocity rotary and downward swirling action about the central axis 32 with total flow being in the downward direction into and through the inlet conduit 15. When the vortex column 30 discharges from the inlet end 17 of the inlet conduit, the liquid immediately starts to disperse outwardly to form the cone-shaped spreading action 37, as shown in FIG. 6.

Figure 6:
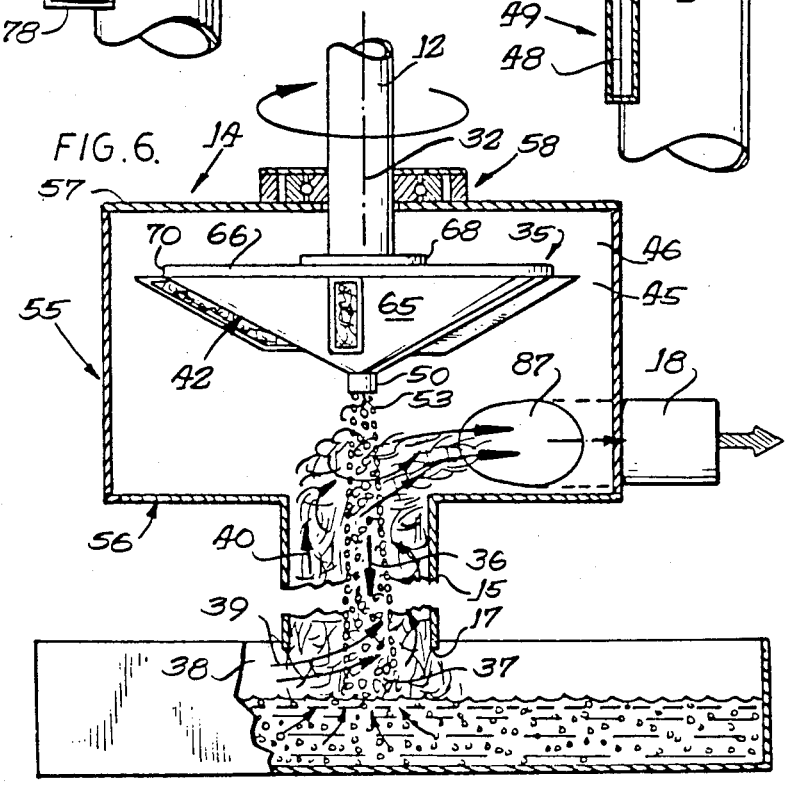
FIG. 6 is a diagramatical illustration of the operation of the pump constructed in accordance with the embodiment of FIG. 1.
Figure 7:
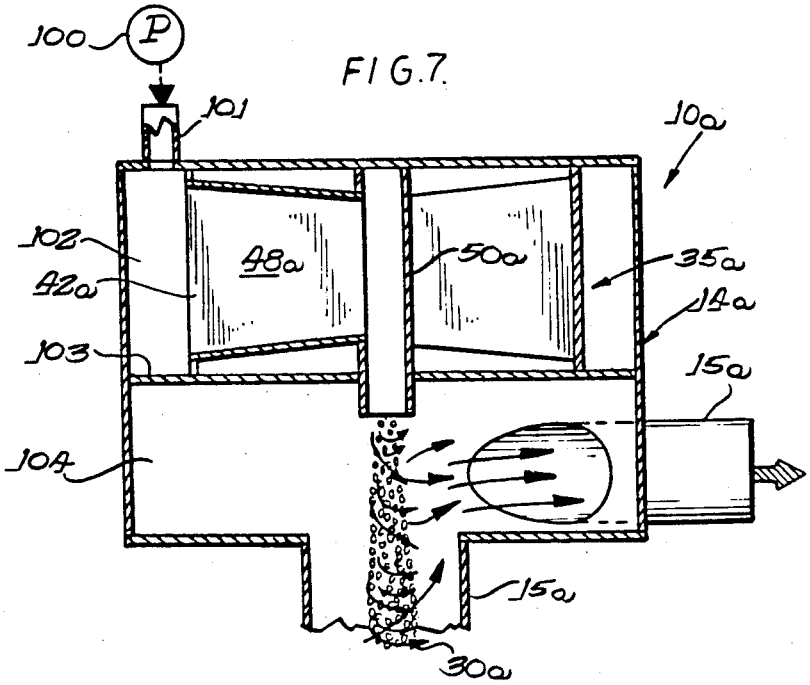
FIG. 7 illustrates another and further embodiment of the invention which uses a fixed member to generate the vortex column of liquid.

It is believed that the vortex member 35 concentrates the energy being imparted to the liquid to form a relatively slender, vertical column of liquid having a high angular velocity and a high downward velocity component which upon reaching the end 17, at which it exits its energy is quickly dissipated into the surrounding ambient liquid 38 which swirls as shown by the directional arrows 39 in FIG. 6 about the vortex column in an upward direction as shown by the directional arrows 40 whereas a directional arrow 36 shows that the vortex liquid is flowing downwardly. It is this counter flow of liquids in opposite directions within the inlet conduit 15 that gives rise to the designation of this pump as an eddy pump. The upward traveling liquid also has a highly angular velocity and a high upward velocity so that the casing 14 is rapidly replenished with liquid for discharge from the outlet 18.

Figure 2:
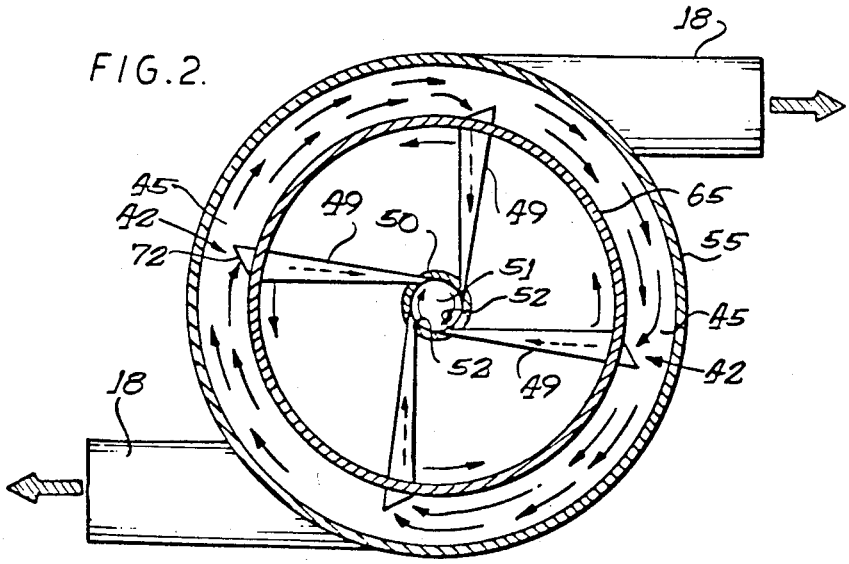
FIG. 2 is an enlarged cross sectional view taken substantially along the line 2—2 of FIG. 2.
Figure 3:
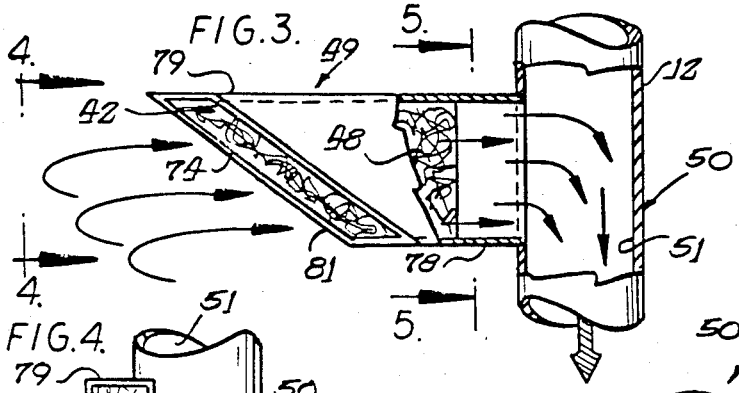
FIG. 3 is an enlarged fragmentary cross sectional view of a vortex generating member constructed in accordance with the FIG. 1 embodiment of the invention.

In accordance with the important aspect of the invention, liquid is taken through inlet openings 42 into the vortex member 35 from the outer peripheral region 45 of a hollow chamber 46 within the housing 14 and is directed through a plurality of passageways 48, as best seen in FIGS. 2 and 3 which extend and which have reducing cross sectional areas so that the liquid is accelerated as it travels generally radially inwardly to a vortex forming means or tube 50. More specifically, a plurality of passageways 48, there being four in the illustrated embodiment of the invention, each provide an accelerating liquid to a hollow interior 51 of the vortex tube at discharge surfaces 53 which are located tangentially to the interior wall of the surface tube so that the liquid is given a swirling action as it enters the tube. Because the top of the tube is closed, the liquid flows downwardly and swirls about the axis 32 of the tube to discharge as the vortex column at the outlet end 53 of the tube.

Referring now in greater detail to the illustrated embodiment of the invention, casing 14 shown in FIG. 1 is formed with a cylindrical metal wall 55 which is coaxil with the axis 32 which extends through the shaft 12 and through the inlet tube 15. The casing 14 includes a top circular wall 57 which may, if desired, have sealed shaft and bearing means 58 for the motor driven shaft 12. The particular manner of mounting the shaft and bearing are herein illustrated as being on the external side of the top plate 57 of the housing. The casing includes a circular lower plate 59 which is connected to the lower end of cylindrical side wall 55 and which has an opening for inlet conduit 15 aligned with the axis 32 for the pump.

The inlet conduit 15 is preferable in the form of a metal cylindrical pipe which is secured to the bottom wall 59 of the casing at the opening in the center thereof. It is to be understood that the casing 14 and inlet conduit 15 may take many shapes and that the cylindrical shapes ashown herein are merely illustrative and are not by way of limitation of the claimed subject matter.

The motor drive means for the vortex generating member 35 includes the electric motor 11 which is mounted on a suitable stand 60 above the bearing means 58. The rotational axis of the electric motor 11 and the driven shaft 12 are along the pump axis 32. Manifestly, various internal motors or other forms of motors or drives may be used from that illustrated in FIG. 1 and still fall within the purview of the present invention.

Figure 4:
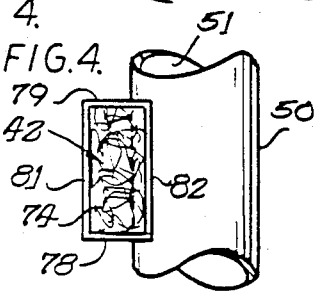
FIG. 4 is a view of an inlet to the rotary member as taken substantially along the line 4—4 of FIG. 3.

The preferred and illustrated vortex generating member 35 shown in FIGS. 2–6 comprises a generally hollow conical shell having an outer conical wall 65 covered at the top by an upper circular horizontally extending top plate 66. The latter is mounted on the lower end of the driving shaft 12 by a plate 68, as best seen in FIG. 6. It is preferred to space the peripheral edge 70 of the upper plate 66 of the vortex forming member at a considerable distance from the casing side wall 55 to alleviate the chance of jamming or otherwise binding the rotating member 35 by solid material compaction therebetween. Preferably, the inlet ends 42 to the passageways 48 are formed in the manner of scoops with an inclined forward wall 72 (FIG. 2) with the scoops rotating in the counterclockwise direction shown in FIG. 2 to scoop in liquid through the inlets 42. Preferably, as best seen in FIG. 4, the inlet 42 includes a filter screen 74 or other filter device to prevent the flow of large size particles into the passageways 48 as would clog the same at their narrowest ends. Each of the inlets 42, is at the same radial distance from the central pump axis 32; and each passageway 48 provides the same liquid flow path between its inlet 42 and the vortex tube 50 so that the particles of water entering each one of the four inlets 42 at the same vertical height in the pump casing undergo the same length of travel and undergo the same acceleration in their travel to the vortex tube and should likewise enter the vortex tube at the same substantially tangential angle to the interior wall 51 of the tube 50 as illustrated in FIG. 2. It will be appreciated that the angle of the passageways 48 to the vortex tube may be changed from tangential to another angle and still form the vortex and fall within the purview of the present invention.

Figure 5:
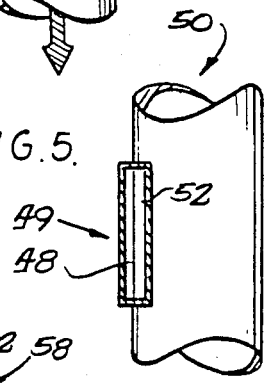
FIG. 5 is a cross sectional view of the passageway in the rotating member taken substantially along the line of 5—5 in FIG. 3.

The illustrated passageways 48 are each formed in a metal tubular channels 49 of parallepiped shape having four walls. More specifically, the channels 49 have parallel upper and lower walls 78 and 79 which extend generally horizontal in their direction from the vortex forming tube 50 as best seen in FIG. 3. The upper and lower walls 78 and 79 are joined to vertical channel side walls 81 and 82 which are inclined towards one another from the inlets 42 to their inner discharge outlets or orifices 52 at the vortex forming tube 50. Herein, the side walls 81 and 82 are straight, but in other instances they could be curved. As best seen between the comparison of FIGS. 4 and 5, the cross sectional area at the inlet 42 is about four times larger than the area at discharge orifice 52, as shown in FIG. 5. It will also be appreciated as shown in FIG. 6 that the inlets 42 extend and are generally tapered to be similar to the taper of the conical shell surface 65 from which they project.

From the above, it will be seen that in the preferred embodiment of the invention, the liquid in the upper half of the casing chamber 46 will be flowing through the inlets 42 whereas the remaining liquid and that bearing most of the suspended solids will be flowing through lower half of the chamber 46 and about the vortex column to discharge out an opening 87 (FIG. 6) in the cylindrical side wall 55 to which is attached a discharge pipe 88. In this instance, there are provided two pump discharges 18 each having a discharge pipe 88. The number of discharges may be only one, or a greater number than two, depending upon the end use of the pump.

The vortex tube 50 for forming the vortex initially, and to discharge the same from the rotating member 35 is preferably in the form of a cylindrical metal tube which has been perforated in a vertical direction at four circumferentially, equally spaced locations and to which are welded or otherwise secured the inner ends of the passageway channels 49. As best seen in FIG. 6, the vortex tube 50 extends beneath the lower conical end of the shell 65 to its discharge end 53 which may be spaced a short distance below the shell wall 65. The distance that the vortex tube extends downwardly may be increased or decreased from that illustrated herein. Also, the preferred vortex forming means, or tube, may be changed considerably in shape and in structure from that shown herein and still fall within the purview of the present invention.

The inlet tube 15 shown herein is a straight cylindrical metal pipe. It is understood that the particular material used or the length of the inlet conduit 15 may be changed substantially from that illustrated herein. It is contemplated that flexible housing made of plastic, or other materials, may be attached to the inlet and extend downwardly for long distances, for example, 70 feet or more, when used for deep dregging, or silt, or mining operations.

Figure 8:
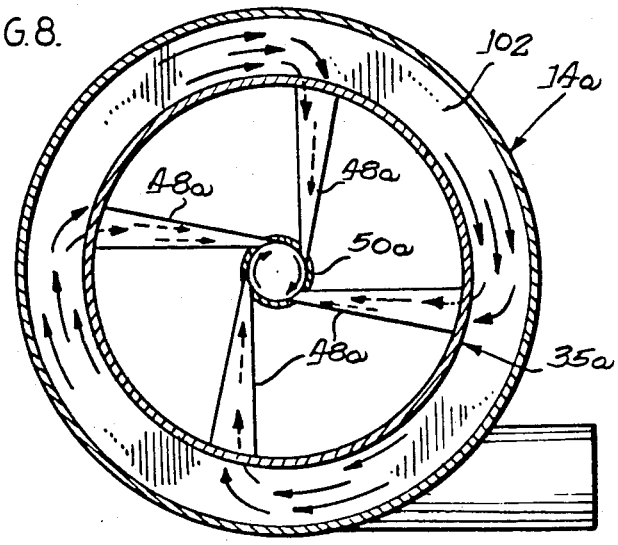
FIG. 8 is a cross sectional view taken through the stationary vortex generating member of FIG. 7.

In accordance with the further embodiment of the invention, as best illustrated in FIGS. 7 and 8, another embodiment of the invention is illustrated with the suffix added to the same reference characters to describe similar elements. In the embodiment of FIGS. 7 and 8, there is no motor drive means, instead, another pump or device 100 supplies a high velocity flow of liquid through an inlet 101 to first or upper chamber 102 which is separated by fixed imperforate plate 103 forming a second or lower chamber 104 in the casing 14*a*.

Thus, the incoming high velocity stream of liquid will flow circumferentially in the chamber 102, as best seen in FIG. 8, through inlet openings 42*a* to flow down reduced cross section area passageways 48*a* to enter a vortex forming means, or tube 50*a*. The water, or other liquid is accelerated as it travels radially inwardly through the reduced cross section channels or passageways 48*a* to exit tangentially into the vortex tube 50*a* to cause the swirling downward action to form the vortex column 30*a* which flows downwardly through the inlet conduit 15*a*. The action of the vortex column 30*a*, upon exiting the inlet 15*a* is the same as above described in connection with the embodiment of FIG.S 1–6. That is, in a like manner, an outer whirling stream of water flows in the reverse, upward direction about the vortex column 30*a* into the lower chamber 104 and then out an orifice 87*a* and discharge 18*a*. In each of the embodiments illustrated above, it has been found that in addition to the opening 17 at the bottom of the inlet conduit 15, that additional inlets such as 120 shown in phantom lines in FIG. 1 may be provided in the side wall of the inlet conduit 15 at any number of locations and that liquid will flow therethrough into the inlet conduit 15 while liquid is also being drawn upwardly from the inlet end 17 to flow upwardly about the downwardly moving vortex column 30 of liquid.

By way of example only the size of illustrated embodiment of the invention in FIG. 1 will be given. The illustrated pump has a 6-inch diameter cylindrical casing 14 and with the maximum diameter of the rotating vortex generating member 35 is 4 inches leaving approximately a 2 inch spacing therebetween for the peripheral region 45 of the chamber 46. The width of the inlets 42 is approximately 2 inches and the width of discharge orifices 52 at the vortex tube 50 is $\frac{1}{2}$ inch, meaning that there was a one-fourth reduction in the width of the channels 49 and the passageways 48 between their inlets and outlets. The illustrated vortex tube is a one-inch diameter pipe. The illustrated inlet conduit 15 is a $2\frac{1}{4}$ inch diameter pipe. The illustrated embodiment had one discharge pipe 18 of $1\frac{1}{2}$ inch in diameter. An eight horsepower motor was used at 900 rpm to drive the pump.

From the foregoing, it will be seen that rather than having closely fitted members and casings or housings, as in the conventional centrifical pump, the present invention uses the formation of a vortex column which has highly rotational, narrow, almost cylindrical band of water which tapers and spreads slightly in the downward direction in the inlet tube until exiting the same at which time all of the energy concentrated into the vortex column is released into the ambient pool of water around the inlet end and this together with the whirling action lifts the ambient water swirling in the same direction but an upward counter movement to the downwardly flowing of vortex movement. Preferably, the pump shown in FIG. 1 should be submerged initially to assure the initial formation of the vortex. It is believed that the water exiting the inlet pipe creates the area of lowest pressure or greatest suction as the pump in contrast to conventional pumps in which lowest pressure is created in the pump housing under the impellor. Most of the liquid entering the casing chamber 46 is discharged out the outlets 18 while some of the liquid flows thereabove and is scooped into the openings in the rotating vortex forming member. If desired, short fins, or paddels may be attached to the rotating vortex member 35 to form into it more an impeller to provide an assist to the water outflow. However, it is the unique acceleration of the liquid from the outer region 45 into the centrally located vortex forming tube with each of accelerated water jets coming into the vortex tube that provides the circular motion to form the vortex which then forms a very tight spiral of water flowing downwardly from the tube and across a portion of the chamber and through the inlet conduit. Each of the accelerating streams in the passageways is identical so that they are in harmony with each adding to the other without creating turbulences or other counterflows that would subtract from their accumulative effect on each other. Although four channels 49 with passageways are used herein in the vortex generating member, this number may be varied to have either fewer or more channels 49.

Various structures have been illustrated herein, other improved embodiments may use various other forms of structure and still fall within the purview of the present invention. For instance, it is contemplated that improved results may be obtained by forming the passageways 48 in a convolute shape with a large outer diameter to cause the water to spiral downwardly and inwardly through a tapered, reducing and cross-section to accelerate the water continuously in not only a radial but also in a downward direction until it enters the vortex tube.

By way analogy only, the swirling column of liquid could be considered to a whirlpool but flowing downwardly. On the other hand, if the inlet pipe 15 were submerged and upstanding from the casing, the water vortex column would be traveling upwardly as in a whirlpool. In tornadoes or whirlpools, the high angular velocity flow is known to create very great suction to pull material inwardly to the vortex and to be lifted thereby. It is thought the the present invention may be analagous to such naturally occuring phenomena.

What is claimed:

1. A pump apparatus for generating a vortex of liquid to pump ambient liquid comprising:

a pump casing having an internal chamber for receiving a liquid therein, means for generating a rotational column flow of liquid about a predetermined axis of liquid flowing in a first direction, a pump inlet having inlet conduit connected to the pump casing for receiving in the center thereof the rotational column of liquid, the rotational column discharging at the end of the pump inlet conduit thereby inducing inwardly into the inlet conduit and in a direction opposite to the rotational column in said pump inlet, and a pump discharge connected to the pump chamber for discharging ambient liquid flowing into the chamber and thereafer discharged through said pump discharge.

2. A method of pumping liquid through a pump housing from an inlet through a housing outlet, said method comprising the steps of:

flowing a plurality of streams of liquid from the outer peripheral portion of the housing toward a common location, increasing the stream velocities during their travel in an inward direction, converging each of streams together at a central location and forming a rotational column of liquid flowing from the common location, moving the rotational column along a path toward an inlet, and discharging liquid from the rotational column and at the inlet drawing liquid into the inlet and flowing liquid in a direction counter to the direction of rotation of the vortex into the housing, and discharging liquid from a housing outlet.

* * * * *